US008549775B2

(12) United States Patent
Lanting et al.

(10) Patent No.: US 8,549,775 B2
(45) Date of Patent: Oct. 8, 2013

(54) LATCHING SYSTEM FOR SECURING AN IMPLEMENT TO A CARRIER MOUNTED TO A LIFTING ARM

(75) Inventors: Henry A. Lanting, Dunnville (CA); Radu T. Guja, Welland (CA)

(73) Assignee: Deere & Company, Moline, IL (US)

( * ) Notice: Subject to any disclaimer, the term of this patent is extended or adjusted under 35 U.S.C. 154(b) by 380 days.

(21) Appl. No.: 13/012,233

(22) Filed: Jan. 24, 2011

(65) Prior Publication Data

US 2012/0189374 A1 Jul. 26, 2012

(51) Int. Cl.
*E02F 3/28* (2006.01)

(52) U.S. Cl.
USPC ..... 37/468; 414/723

(58) Field of Classification Search
USPC ..... 37/403, 468; 414/723, 699; 91/424; 403/322, 322.3, 322.4, 321, 31; 172/272, 273
See application file for complete search history.

(56) References Cited

U.S. PATENT DOCUMENTS

| | | | | |
|---|---|---|---|---|
| 5,466,113 | A | 11/1995 | Norberg | |
| 5,562,397 | A * | 10/1996 | Albright | 414/723 |
| 5,769,596 | A | 6/1998 | Burton | |
| 7,001,137 | B2 | 2/2006 | Perrin et al. | |
| 7,467,918 | B2 | 12/2008 | Yao et al. | |

* cited by examiner

*Primary Examiner* — Robert Pezzuto
(74) *Attorney, Agent, or Firm* — Quarles & Brady LLP

(57) ABSTRACT

A remotely operable latching system for securing an implement to a carrier mounted to a forward end of a lifting arm for pivoting about a horizontal tilt axis. The latching system is mounted to the carrier and includes a latching rod arrangement operated by an extensible and retractable linear electric motor between a retracted latching position and an extended unlatching position. A secondary latch arrangement is provided for rotating the latching rod arrangement to an arrested position preventing movement of the rod arrangement to its latching position once the latching rod is extended to its unlatching position. Movement of the rod arrangement to its arrested position is aided by a spring and by the electric motor. A microprocessor based control unit is coupled to the electric motor and acts in response to a boom height input signals to prevent operation of the motor when the boom is above a preset height.

9 Claims, 11 Drawing Sheets

LATCHING SYSTEM FOR SECURING AN IMPLEMENT TO A CARRIER MOUNTED TO A LIFTING ARM

FIELD OF THE INVENTION

The present invention relates to an arrangement for securing an implement to a carrier mounted to lifting arms, particularly those of a front loader boom, where the implement and carrier can be fastened to each other by movable latch rods that can be moved between latched and unlatched positions either manually or by a remotely controlled motor.

BACKGROUND OF THE INVENTION

A known type of latch arrangement for securing an implement to a carrier mounted to lifting arms of a boom comprises a rod arrangement mounted to the carrier for being shifted laterally between latched and unlatched positions, with the rod arrangement being spring biased to its latched position. The rod arrangement can be either manually or hydraulically moved to the unlatched position, where a secondary latch is engaged by partially rotating the rod by the action of a second spring. The rod arrangement can then be released with the rod arrangement remaining in an arrested unlatched position until an implement coupled to the carrier is rolled back so as to engage the latch rod arrangement causing it to rotate out of its arrested position thereby disengaging the secondary latch permitting the latch rod arrangement to be moved to its latched position by the biasing spring. Such a prior art securing arrangement is disclosed in U.S. Pat. No. 7,001,137.

Another known type of latch arrangement includes a remotely operable latch rod arrangement which is biased toward a latched position and is selectively moveable to an unlocked position by an extensible and retractable hydraulic cylinder controlled by a solenoid operated valve which is controlled by a circuit including a latching control switch and a height control switch connected in series so that both must be closed to complete a circuit to the control valve so as to prevent unlatching if the height sensing switch senses a height above a preselected safe height for implement detachment. U.S. Pat. No. 7,467,918 discloses such a prior art latch rod control.

One drawback associated with the patented designs is that a failure of the biasing mechanism when the implement is attached to the boom could result in the latch rod migrating to its unlatched position. Another drawback of the patented designs is that an operator may not be aware if the latching rod arrangement becomes jammed or the like resulting in a partially latched implement. Further, while hydraulic cylinders are effective devices for moving the latching rod arrangements to their unlatched positions, hydraulic fluid leakage is always a problem and the provision of hydraulic hoses and control valves often take up valuable space and require special design considerations resulting in increased cost.

SUMMARY OF THE INVENTION

According the present invention, there is provided an improved remotely operated latching system for detachably connecting an implement to a carrier mounted to a lifting arm.

An object of the invention is to provide a remotely operated latching system which is compact and reliable.

A more specific object of the invention is to provide latching system including a latch rod arrangement which is extendable from a latched position to an unlatched position, with a secondary latch arrangement being provided for rotating the latch rod arrangement into an arrested position once the latch rod arrangement in its extended, unlatched position, with an actuator for extending the latch rod arrangement acting to aid rotation of the latch rod arrangement into its arrested position.

These and other objects are accomplished by using a linear electric motor for operating the latching rod arrangement, with a microprocessor based digital electronic control for the motor including safety interlocks for preventing unlatching of the implement if the boom is not in a lowered position. The electronic control unit also includes a capability to monitor operating conditions and to apprise the operator of the operating condition, through the means of an LEDs, where a slowly flashing light indicates that the latch rod arrangement is being extended to establish an unlocked condition, a quickly flashing light indicates a jammed condition and full extension being indicated by a steady light. The motor control includes an operating switch which may be placed in a manual over-ride mode whereby the operator may cycle the motor to extend and retract the latch rod arrangement such as to use the latching sections of the rod arrangement to "chip" through frozen material, or the like, blocking the passage of the latching sections to the latching position.

These and other objects of the invention will be understood by a reading of the ensuing description together with the appended drawings

DESCRIPTION OF THE PREFERRED EMBODIMENT

Figure 1:
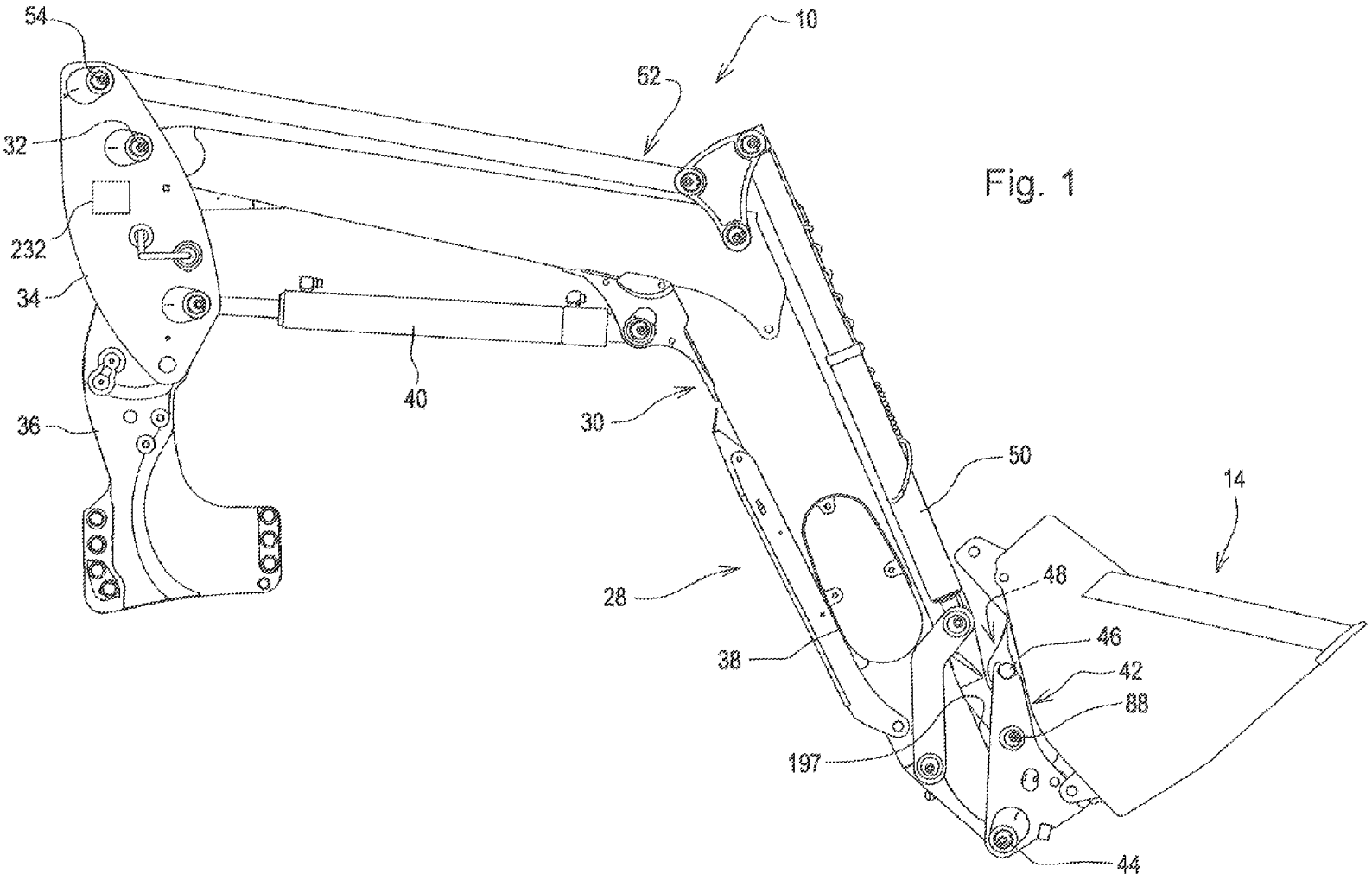
FIG. 1 is a right side elevational view of a loader boom having a rear end mounted to a support frame and a front end coupled to an implement carrier to which an implement is attached.

Referring now to FIG. 1, there is shown a front end loader 10 equipped with an attachment in the form of a bucket 14. However, it is to be understood that the present invention may be used with other loaders and/or attachments.

The loader includes a boom 28 comprising left and right, transversely spaced, fore-and-aft extending arms (only right arm 30 being shown) disposed for extending along opposite sides of a tractor (not shown) and each having a rear end pivotally attached, as by a pin 32, to an upper region of a respective one of a pair of upright masts 34, the masts 34, in turn, being fixed to respective upper regions of a pair of upright mounting frames 36 located on opposite sides of, and having lower regions fixed to a frame (not shown) of the tractor. The boom 28 further includes a cross tube (not visible) having opposite ends projecting through, and joining the arms 30 together at a location forwardly of the tractor, with caps 38 being mounted on outer faces of the arms 30 so in closing relationship to opposite open ends of the cross tube.

Mounted between a lower region of each of the masts 34 and the associated boom arm 30 is an extensible and retractable boom lift cylinder 40 having its rod end coupled to the mast 34 and its barrel end coupled to the arm 30. An implement carrier 42 is pivotally attached, as at pins 44 to lower front end regions of each of the boom arms 30, the carrier 42, in turn, including an upper cross member 46 received within downwardly opening receptacles (not visible) of transversely spaced hooks 48 (only one shown) fixed to an upper region of the a backside of the bucket 14. The bucket 14 is detachably coupled to a bracket arrangement (not shown) provided on the backside of the bucket 14, as is described below in further detail. Provided for pivoting the carrier 40 about a horizontal axis defined by the pins 44 are a pair of extensible and retractable bucket tilt cylinders 50 (only one shown), each of which form one link of a leveling linkage 52 coupled, as at a pin 54, between an upper end of each mast 34 and the implement carrier 42, with extension of the cylinders 44 effecting clockwise rotation of the carrier 42 and associated bucket 14 about the horizontal axis defined by the pins 44, while retraction of the cylinders 50 effects counterclockwise rotation of the carrier, and, hence, effects roll back of the associated bucket 14, such roll back operation being important in the operation of latching the bucket 14 to, and detaching the bucket from, the carrier 42, as is described below in further detail.

Figure 2:
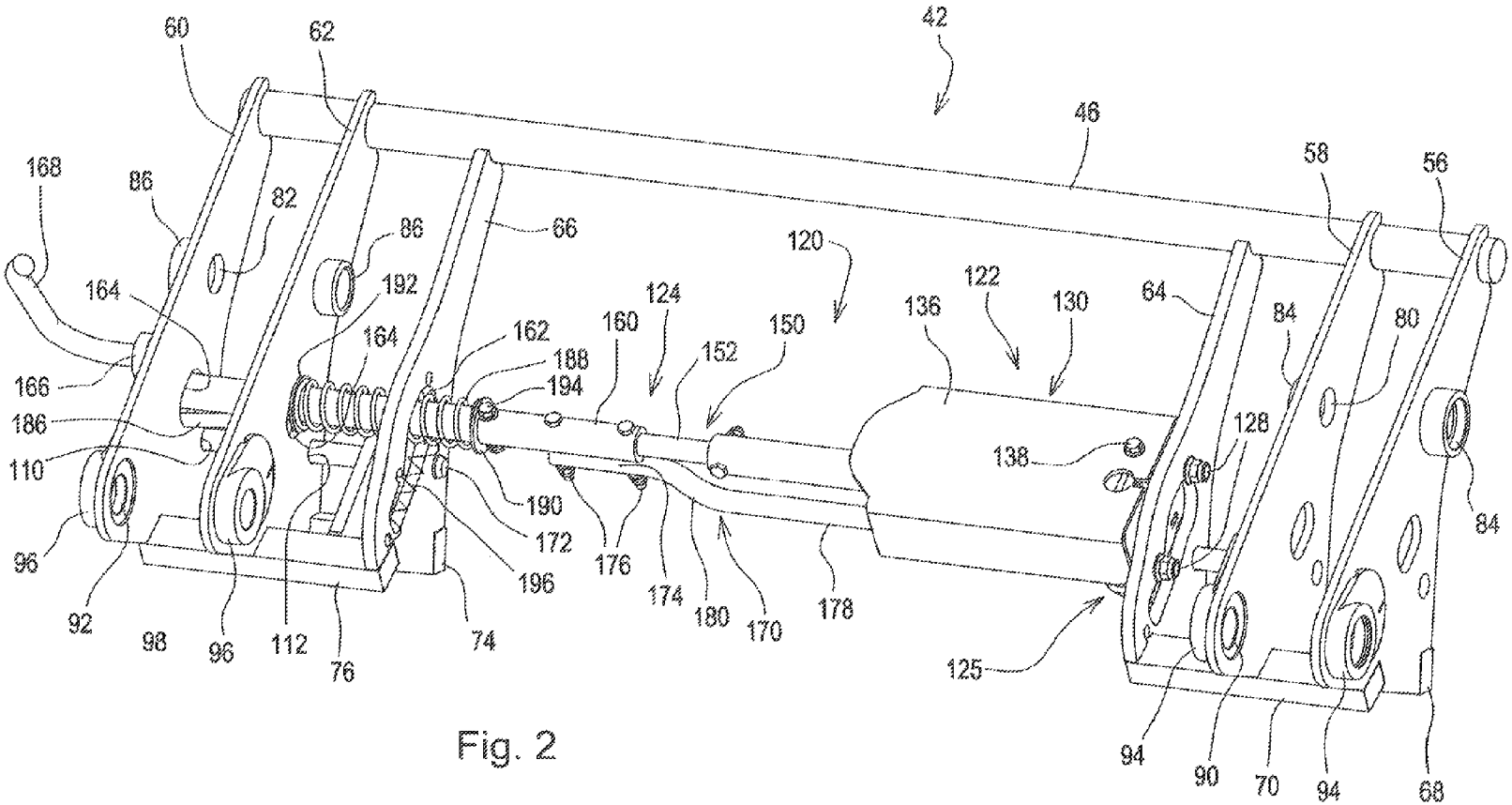
FIG. 2 is a right rear perspective view of an implement carrier equipped with a remotely controlled latching mechanism constructed in accordance with the principles of the present invention and showing the latch rod arrangement in a latched condition for securing an implement to the carrier.
Figure 3:
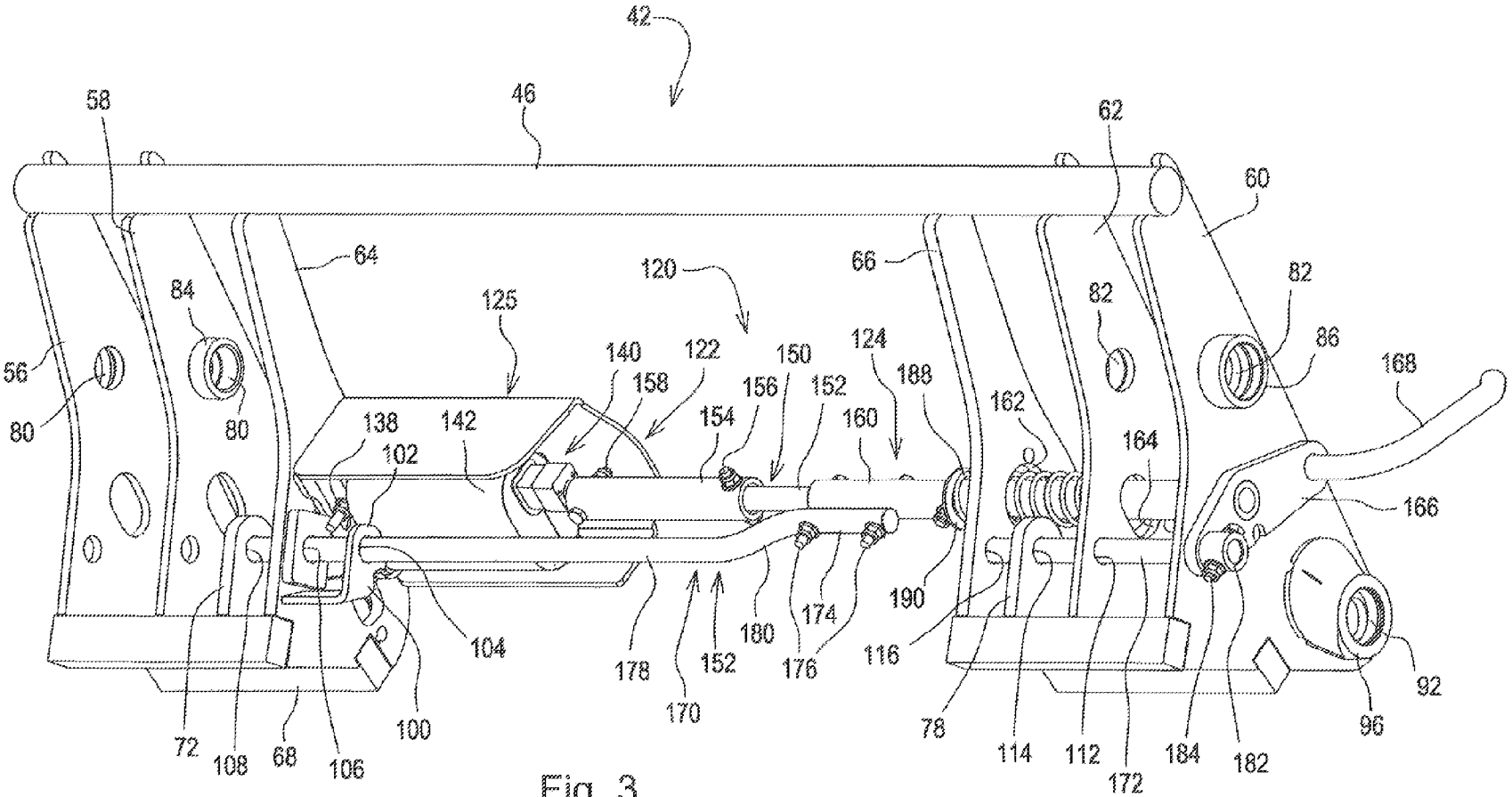
FIG. 3 is a right front perspective view of the implement carrier and latching mechanism shown in FIG. 2.

Referring now to FIGS. 2 and 3, it can be seen that the cross member 46 at the top of the carrier 42 has right and left end regions to which are attached right and left vertical plate assemblies. Specifically, the right vertical plate assembly includes a pair of transversely spaced outer and inner loader arm mounting plates 56 and 58, respectively, having upper ends fixed to the right end region of the cross member 46. Similarly, the left vertical plate assembly includes outer and inner loader arm mounting plates 60 and 62, respectively, having upper ends fixed to the left end region of the cross member 46. The right and left vertical plate assemblies 56, 58 and 60, 62 each have a fore-and-aft dimension that increases from top to bottom. While not required for carriers of smaller loaders, the carrier 42 further includes right and left, inner strengthening plates 64 and 66 also having upper ends joined to the cross member 46 and having lower ends that terminate forwardly of lower ends of the plates 56-62. The bottoms of the plates 56, 58 and the right inner plate 64 are joined together by a right rear cross bar 68, while lower front regions of the plates 56, 58 and 64 are joined together by a right front cross bar 70. Extending between and fixed to the front and rear cross bars 68 and 70 at respective locations spaced outwardly from the inner plate 66 is an upwardly projecting locking bar receiving plate 72. Similarly, the bottoms of the plates 60, 62 and 66 are joined together by a left rear cross bar 74 having an inner end joined to a bottom rear location of the plate 66, and being welded within complementary notches provided in the lower edges of the plates 60, 62, while a front cross bar 76 extends between and is joined to lower front regions of the plates 60, 62 and 66. Extending between and fixed to the left rear and front cross bars 74 and 76, at locations spaced outwardly from the left inner plate 66, is an upwardly projecting locking bar receiving plate 78.

A right tilt linkage mounting hole arrangement includes a pair of horizontal, axially aligned holes (only hole 80 in the plate 58 being visible) provided at an upper region in the right plate assembly comprising the plates 56, 58, while a left tilt linkage mounting hole arrangement includes a pair of horizontal, axially aligned holes (only hole 82 in plate 54 being visible) provided at a mid-height location of the plates 54, 56 in axial alignment with the holes 74. Respectively fixed to outer and inner faces of the plates 56, 58 of the right plate assembly are a pair of short cylindrical tubes 84 that are arranged in axial alignment with the holes 70. Likewise, a pair of short cylindrical tubes 86 are fixed to the inner and outer surfaces of the left plate assembly comprised by the inner and outer plates 54 and 56 so as to be in axial alignment with the holes 82. Referring back to FIG. 1, it can be seen that a pin 88 is received in each of the aligned pairs of holes 80 and 82 and serve to fix one end of a link of the bucket tilt linkage 52 to the right pair of arm mounting plates 56, 58 of the carrier 42.

A right loader boom mounting hole arrangement includes a second pair of axially aligned holes (only hole 90 in plate 58 being visible) provided at lower rear locations of the plates 56 and 58, and a left loader boom mounting hole arrangement includes a second pair of axially aligned holes (only hole 92 in plate 60 being visible) respectively provided at lower rear locations in the left pair of plates 60 and 62. Fixed to outer and inner surfaces respectively of the right plate assembly, comprised of the pair of plates 56 and 58, so as to be in axially alignment with each other and with the holes 90 are short cylindrical tubes 94. Similarly, fixed to outer and inner surfaces respectively of the left plate assembly comprised of the pair of plates 60, 62 so as to be in axial alignment with each other and with the holes 92 are short cylindrical tubes 96. When the carrier 42 is mounted to the loader boom 28, the right pair of boom arm mounting plates 56, 58 and the left pair of boom arm mounting plates 60, 62 respectively straddle lower front regions of the right and left boom arms 30, with the holes 90 and 92 respectively receiving the pins 44 (see FIG. 1).

Figure 4:
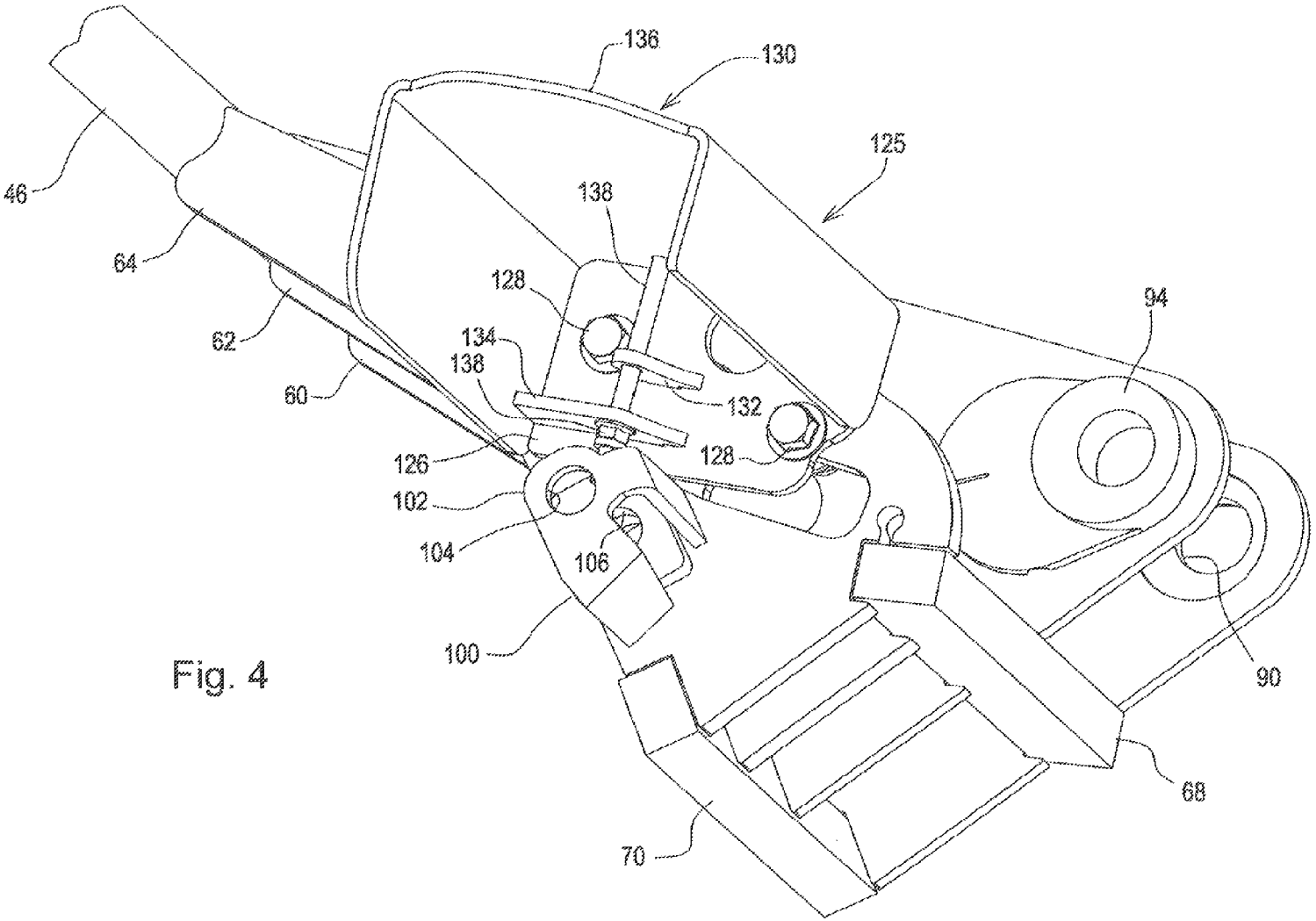
FIG. 4 is an enlarged left bottom perspective view of a right end region of the carrier of FIG. 2 showing the mount and shield assembly for the electric motor.

Spaced below the pair of hooks 48 on the back side of the bucket 14 (see FIG. 1) are right and left, rearwardly projecting mounting lugs (not visible) respectively located for being received between the right strengthening plate 64 and the right latch rod receiving plate 72, and between the left strengthening plate 66 and the left latch rod receiving plate 78. Referring now also to FIG. 4, it can be seen that a latch rod guide 100 is mounted to an inner surface of the right strengthening plate 64, the guide 80 including a vertical portion 102 extending parallel to, and being spaced inwardly from the plate 64, with the vertical portion containing a rod-receiving hole 104 disposed in horizontal axial alignment with rod-receiving holes 106 and 108, respectively provided in the strengthening plate 64 and the rod-receiving plate 72. On the left side of the carrier 42, the loader arm mounting plates 60, 62, the latch rod-receiving plate 78 and the strengthening plate 66 respectively contain axially aligned holes 110, 112, 114 and 116 that are in axial alignment with the holes 84-88 and define a latch assembly pivot axis, these holes being brought into alignment with bores in the mounting lugs (not visible) of the bucket 14 for receiving latch rod elements, described below, to secure the bucket 14 to the carrier 42.

The present invention relates to a remotely operable latching mechanism 120 including an actuator arrangement 122 and a latch rod arrangement 124.

Referring now also to FIGS. 3 and 4, it can be seen that the actuator arrangement 122 includes a motor mount and shield assembly 125 including a vertical motor mounting plate 126 tightly secured against a left face of the right strengthening plate 64 by a pair of bolt and nut assemblies 128. As can best be seen in FIG. 4, the support plate 126 is received within, and is shaped complementary to and is welded to, a right end region of an inverted channel-shaped motor shield 130, which projects leftward from the strengthening plate 64. Joined to, and projecting leftward from, a left face of the support plate 126 is a motor mounting clevis defined by upper and lower flanges 132 and 134, which are disposed in parallel relationship to a top 136 of the shield 130, the top 136 being inclined downwardly from front to rear. A bolt stem 137 of a motor mounting bolt and nut assembly 138 projects downwardly through the shield top 116 and through the aligned holes provided in the upper and lower flanges 132 and 134 so as to define an upright motor mount pivot axis having a purpose explained below.

Figure 5:
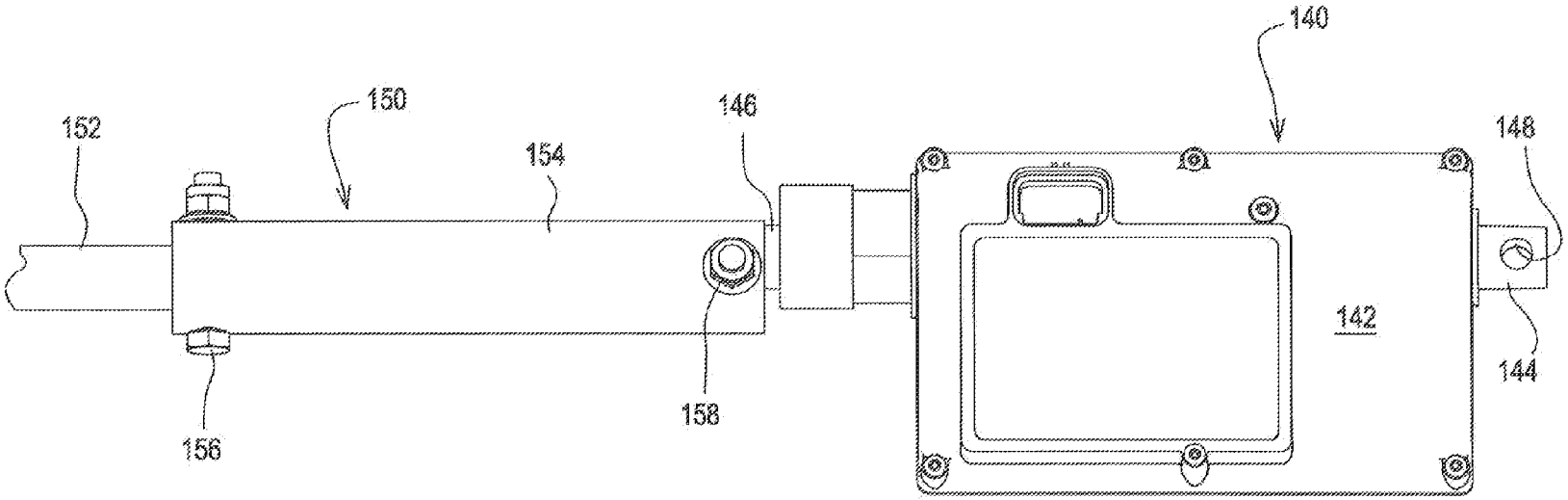
FIG. 5 is a top view of the linear electric motor showing its connection to the right end region of the operating rod assembly of the latch rod arrangement

Referring also to FIG. 5, it can be seen that a linear electric motor 140 comprises a sealed body 142 which is substantially rectangular in cross section. The electric motor 140 has a built in microprocessor (described in more detail below) which continuously monitors the performance of the motor and can be directly interfaced with programmable controllers. An example of a suitable electric motor are those included in the Electrak Pro Series marketed by Danaher Motion located in Radford, Va. Respectively located at front regions of right and left ends of the motor body 142 in approximate transverse alignment with each other are a mounting lug 144, defined by a rod, and an extensible and retractable output shaft 146. The mounting lug 144 contains an upright bore 148 in which the stem 137 of the bolt assembly 138 is received when the motor 140 is mounted beneath the top 136 of the motor shield 130, as shown in FIG. 3, the mounting lug 144 then being received between the motor mount flanges 132 and 134.

Referring back to FIGS. 2 and 3, it can be seen that the latch rod arrangement 124 includes a horizontal, transverse operating rod assembly 150 including an intermediate coupling rod 152 having a right end loosely received within a left end of a tubular coupler 154 and connected thereto by a bolt and nut assembly 156 wherein the bolt stem is disposed crosswise relative to the motor mounting bolt stem 137. The motor shaft 146 is loosely received in a right end of the coupler 154 and is connected thereto by a nut and bolt assembly 158 wherein the bolt stem is disposed parallel to the motor mounting bolt stem 137. A left end region of the coupling rod 152 is tightly received within a right end region of an elongate tubular rod section 160 that is received in an opening 162 provided in the strengthening plate 66, and in a guide slot arrangement comprising a pair of transversely aligned guide slots 164 respectively provided in the loader boom mounting plates 60 and 62, with it being noted that slots similar to the slots 164 are provided in the plates 56 and 58 so that during manufacture the plates 56 and 58 are respectively interchangeable with the plates 60 and 62. As can best be seen in FIG. 3, the left end of the tubular rod section 160 is welded within an opening provided between opposite ends of a flat lever arm 166 disposed perpendicular to the rod section 160. A rod is bent to form a handle 168 having an inner end of a horizontal transverse end section fixed to a rear end of the lever arm 166, and having an outer end joined to a rearwardly extending hand grip portion.

The latch rod arrangement 124 further includes right and left latch rods 170 and 172. The right latch rod 170 includes a mounting portion 174 at its left end which is disposed along a lower front portion of the right end region of the tubular rod section 160, with a pair of nut and bolt assemblies 176 including bolt stems extending through aligned bores provided in the coupling rod 152 and tubular rod section 160 so as to secure the rod 152 within the section 160 while solidly clamping the latch rod mounting portion 174 to the operating rod assembly 150. Extending parallel to, and being axially offset to, the latch rod mounting portion 174 is a latch rod latching portion 178, which is joined to the mounting portion by an intermediate portion 180.

As can best be seen in FIG. 3, the left latch rod 172 includes a left end region which projects through a hole (not visible) provided in a forward end of the flat lever arm 166 and into a cylindrical tube 182 welded onto an outer surface of the arm 166. A nut and bolt assembly 184 secures the latch rod 172 within the cylindrical tube 182.

When the latch rod arrangement 124 is in a latched position, as shown in FIGS. 2 and 3, the latching portion 178 of the right latch rod 170 extends beneath the motor body 142 (FIG. 3) and is received in the axially aligned holes 104, 106 and 108 respectively provided in the rod guide bracket 100, strengthening plate 64 and latch rod receptacle plate 72. The left latch rod 172 is then received in the axially aligned holes 110, 112, 114 and 116 respectively provided in the left boom mounting plates 60 and 62, the latch rod receiving plate 78 and the left strengthening plate 64.

Thus, the operating rod assembly 150 forms a leftward extension of the motor output shaft 146 and has a left end region projecting through the guide slot arrangement comprising the pair of transversely aligned guide slots 164 respectively provided in the left pair of plates 60 and 62. The guide slots 164 are located approximately mid-way between the sets of holes 82 and 92. As described above, the left latch rod 172 is fixed for movement with the operating rod 132 by the flat lever arm 166. A secondary latch rod 186 has an outer end welded to a lower middle location of the lever arm 166 and, when the operating rod assembly 150 is in the latched position shown in FIGS. 2 and 3, the secondary latch rod projects upwardly to the right through a lower region of the guide slot 164 provided in the outer left plate 60, with the lever arm 166 then being disposed in a raised position flat against the left surface of the plate 60. The handle 166 is provided for manual operation of the operating rod assembly 150 in the event of a failure of the electric motor 140.

Figure 6:
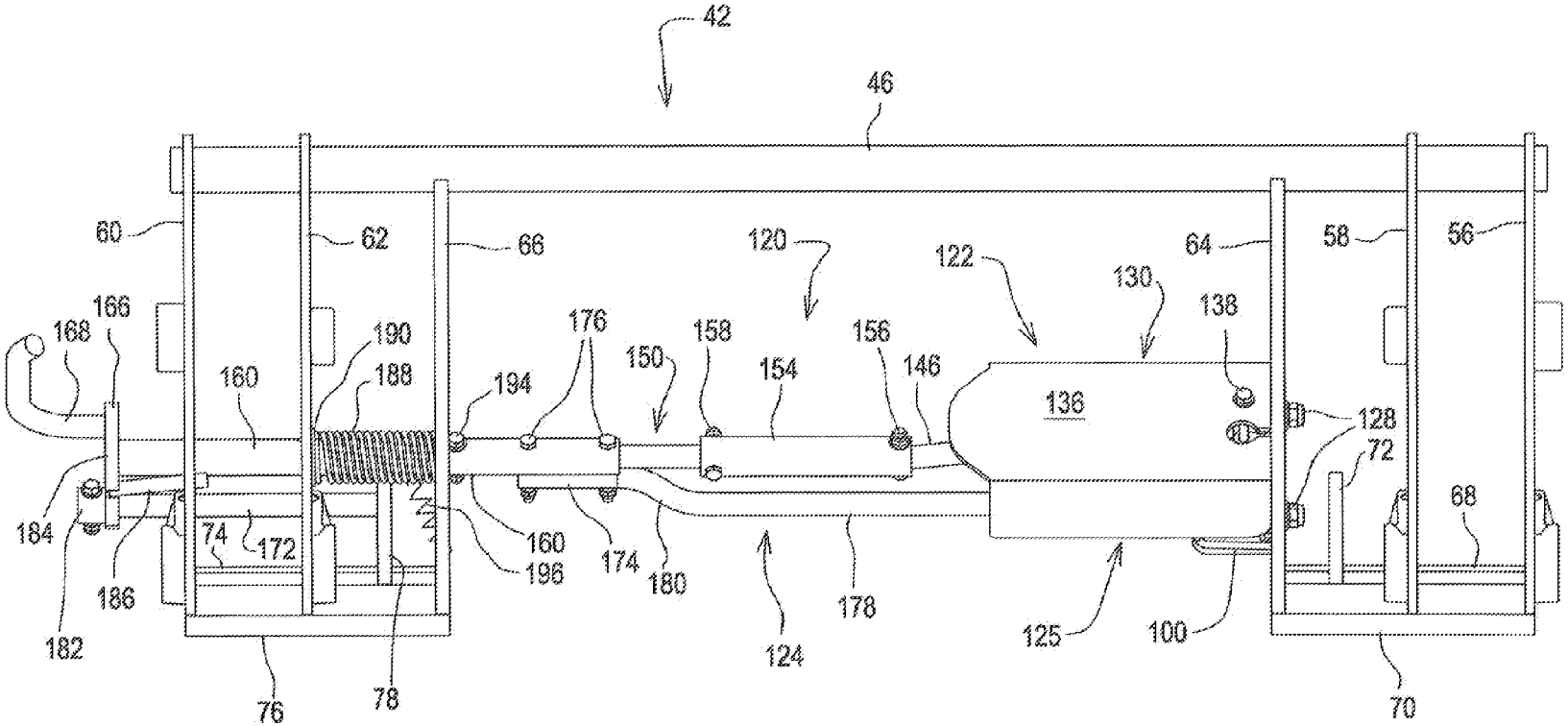
FIG. 6 is a rear view of the carrier shown in FIG. 2, but showing the operating rod in an unlatched position.

Movement of the latch rod arrangement 124 from its latched position shown in FIGS. 2 and 3 to an extended unlatched position, shown in FIG. 6, is resisted by a coil compression spring 188 received on the operating rod assembly 150 at a region just to the right of the inner boom arm mounting plate 62 and having opposite ends engaged with right and left flat washers 190 and 192, respectively, with rightward movement of the washer 190 being prevented by a nut and bolt assembly 194 including a bolt stem projecting through the tubular rod section 160, and with leftward movement of the washer 192 being prevented by the plate 62. As can be seen in FIG. 6, a coil tension spring 196 is coupled under tension with a hook at an upper end being engaged with a coil of the compression spring 188 and with a hook at a lower end being received within a hole provided in the strengthening plate 66, the spring 196 acting to bias the tubular rod section 160 of the operating rod assembly 150 toward the bottom ends of the guide slots 164 for a reason described below.

Figure 7:
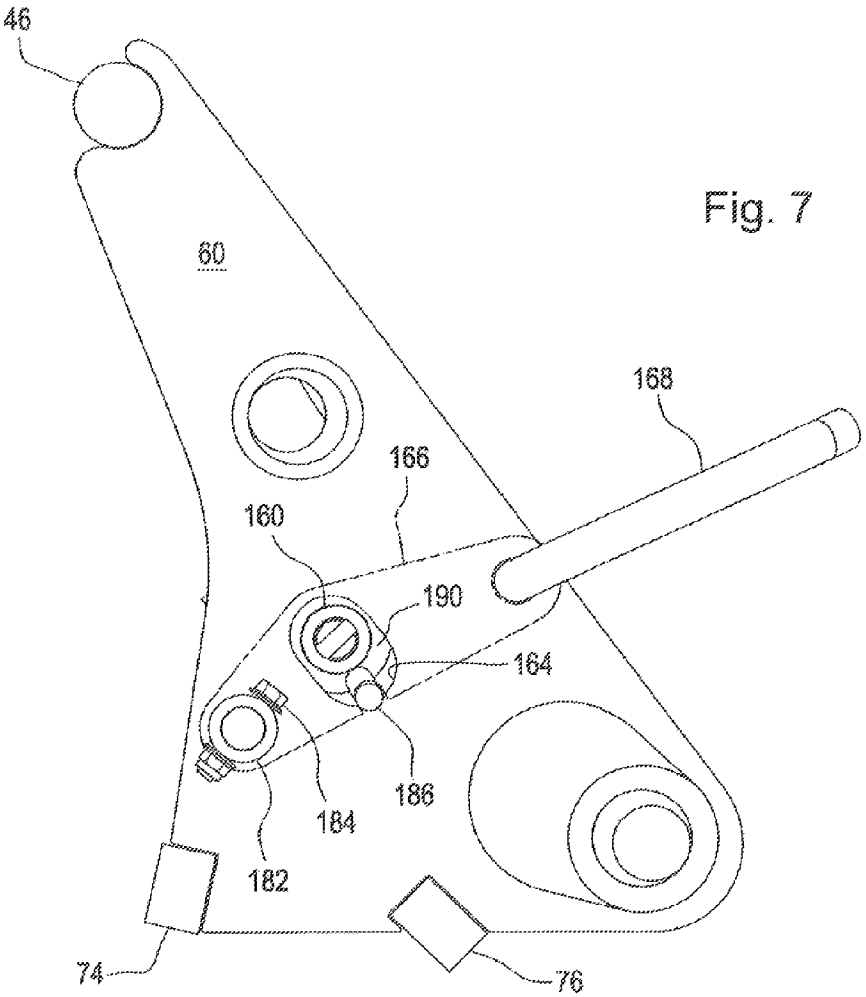
FIG. 7 is a left end view of the carrier shown in FIG. 6, but showing the lever arm in phantom so as to show the latch rod positioned in the upper region of the guide slot and the secondary latch rod positioned in a lower region of the guide slot.
Figure 8:
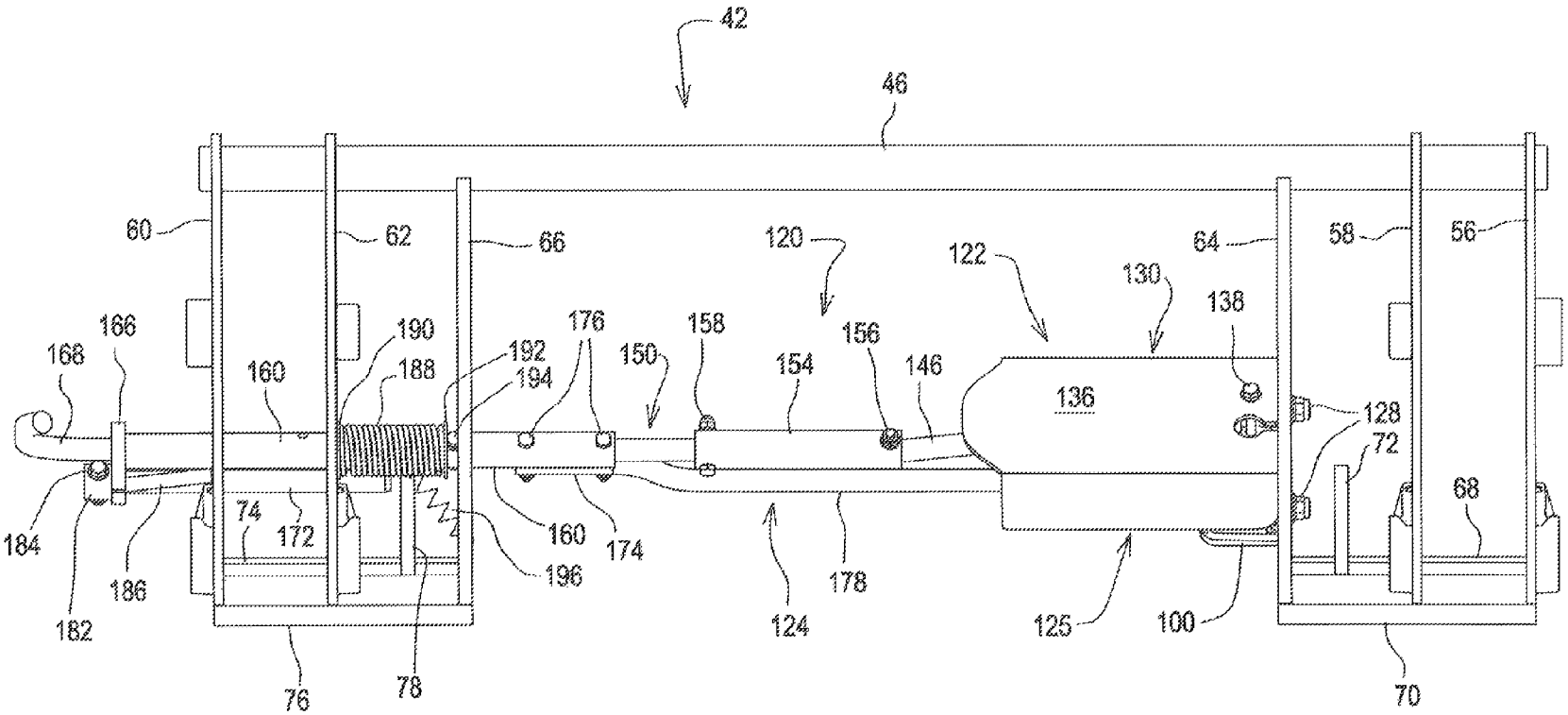
FIG. 8 is a view like FIG. 6, but showing the latch rod arrangement in an unlatched, arrested position.
Figure 9:
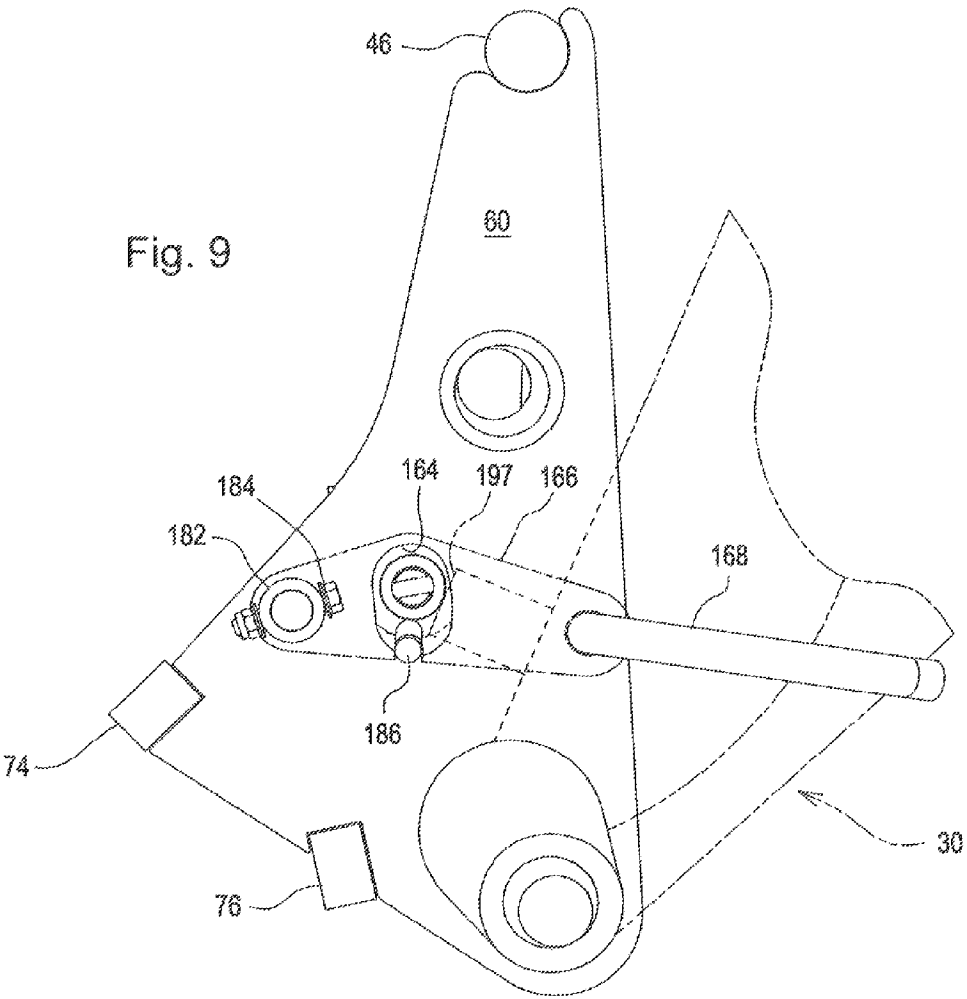
FIG. 9 is a left end view of the carrier shown in FIG. 8, but showing the lever arm in phantom so as to reveal the latch rod arrangement in a lower region of the guide slot and the secondary latch rod below the guide slot, and showing a lower region of the left loader boom arm in dashed lines together with carrier being shown in dashed lines in a rolled back condition wherein an upper surface of the boom arm is in contact with, and holds the latch rod arrangement in a non-arrested position in an upper region of the guide slot, with the secondary latch rod being positioned for re-entry into the guide slot.

The secondary latch rod 186 is provided for retaining the operating rod assembly 150 in an arrested position, as shown in FIGS. 8 and 9, wherein the operating rod assembly 150 has been shifted to the left a sufficient distance to withdraw the secondary latch rod 186 from the guide slot 164, thereby permitting the action of the tension spring 196 to rotate the operating rod assembly 150 about the latch rod axis into a bottom region of the guide slots 164, resulting in the end of the secondary latch rod 186 becoming misaligned relative to the adjacent guide slot 164 so as to retain the operating rod assembly 150 in its extended, unlatched position. As can be seen in FIGS. 7 and 8, the extended motor output shaft 146 is misaligned relative to the axis of the operating rod assembly 150 which means that the motor housing 142 is rotated downwardly about the upright axis defined by the bolt and nut arrangement 138, this downward rotation occurring gradually as the output shaft 146 extends with the result that the motor transfers a downward component of force to the operating rod assembly 150 that is added to that exerted by the tension spring 196 so as to aid in moving the operating tubular rod section 160 to the bottoms of the guide slots 164.

When the carrier 42 is rolled back, as shown in dashed lines in FIG. 9, it can be seen that the tubular rod section 160 of the operating rod assembly 150 comes into contact with a forward surface 197 of the left loader arm 30 and lifts the rod section to the top region of the guide slot 164, with the secondary latch rod 186 then being realigned with the guide slot 164 so as to permit the operating rod assembly 150 to be retracted to its latched position.

Figure 10:
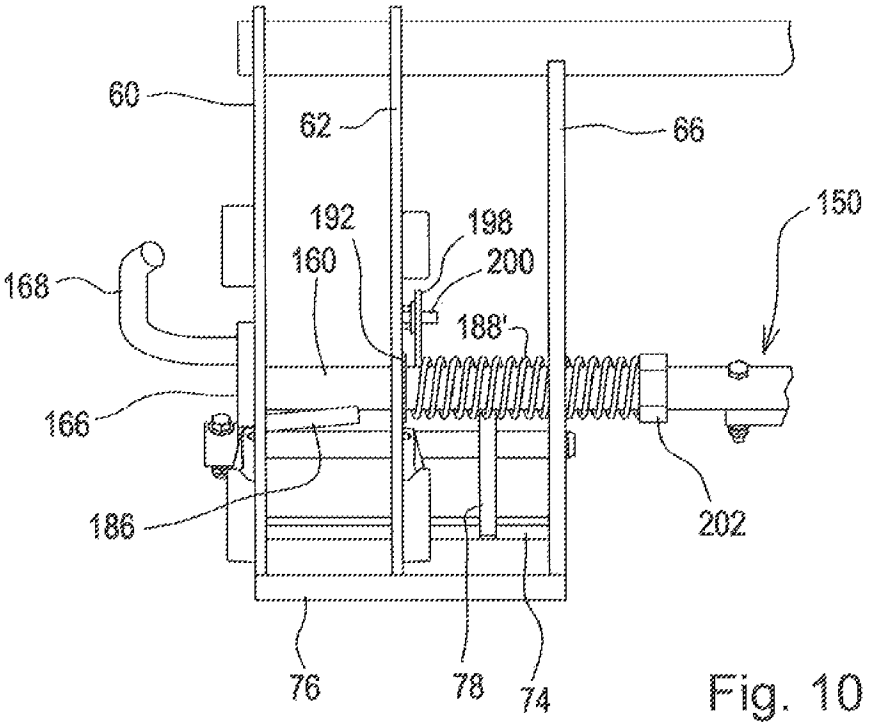
FIG. 10 is a perspective view of a left end region of the implement carrier shown in FIG. 6, but showing an alternate embodiment featuring a coil spring which acts in compression to resist movement of the latch rod arrangement from its latched position while at the same time acting in torsion to bias the operating rod towards the bottom of the guide slot arrangement.

Referring now to FIG. 10, there is shown an alternate embodiment of the manner of effecting the latching of the secondary latch rod 186. Specifically, the compression spring 188 of the first-described embodiment is replaced by a combined helically wound compression and torsion spring 188', the latter having a straight left end section 198 that extends upwardly behind an abutment pin 200 that is fixed to, and projects to the right from, the plate 62 at a location adjacent an upper end of the adjacent guide slot 164. A torsion adjustment nut 202 is secured to a right end of the spring 158' and can be advanced toward the left along a threaded section (not shown) of the operating rod tube section 160 to cause an increase in the torsion pre-load of the spring 188'. Thus, the reaction of the force exerted by the spring end 198 on the abutment pin 200 is transferred through the spring to the tubular rod section 160 so as to urge the operating rod assembly 150 toward the bottoms of the guide slots 164. Accordingly, the tension spring 196 used in the previously described embodiment is no longer needed.

Starting with the implement carrier 42 mounted to the arms 30 of the loader boom 28, an implement, such as the bucket 14 can be attached to the carrier 42 by positioning the carrier 42 so as to bring the cross member 46 into engagement with the downwardly opening receptacles of the mounting hooks 48 provided at the backside of the bucket 14, and then by raising the bucket off the ground far enough that it pivots downwardly against the front of the carrier 42. The transversely spaced pair of mounting lugs (not shown) at the backside of the bucket 14 will at this time be respectively in fore-and-aft alignment with the space between the right latch rod receiving plate 72 and the right strengthening plate 64, and with the space between the left latch rod receiving plate 78 and the left strengthening plate 66. The operator will then operate the bucket tilt cylinders 50 to cause the carrier 42 to roll back about its pivotal connections 44 of the carrier 42 with the boom arms 30. This will cause the arrested operating rod assembly 150 to come into engagement with the front surface 197 of the left loader arm 30 and to be shifted towards the upper end region end of the guide slots 164. At this point, the right end of the secondary latch rod 186 will come into register with the guide slot 164 in the plate 60, while cross bores provided in the bucket mounting lugs will be in axial alignment with the holes respectively provided in the plates 64, 72 straddling the right bucket lug, and provided in the plates 66, 78 straddling the left bucket mounting lug. The motor 140 is then operated to cause it to retract thereby simultaneously moving the right latch rod portion 178 through the bore in the right bucket lug and then into the hole 108 provided in the latch rod receiving plate 72, and moving the left latch rod 172 through the bore in the left bucket lug and then into the hole 116 provided in the left strengthening plate 66.

Figure 11:
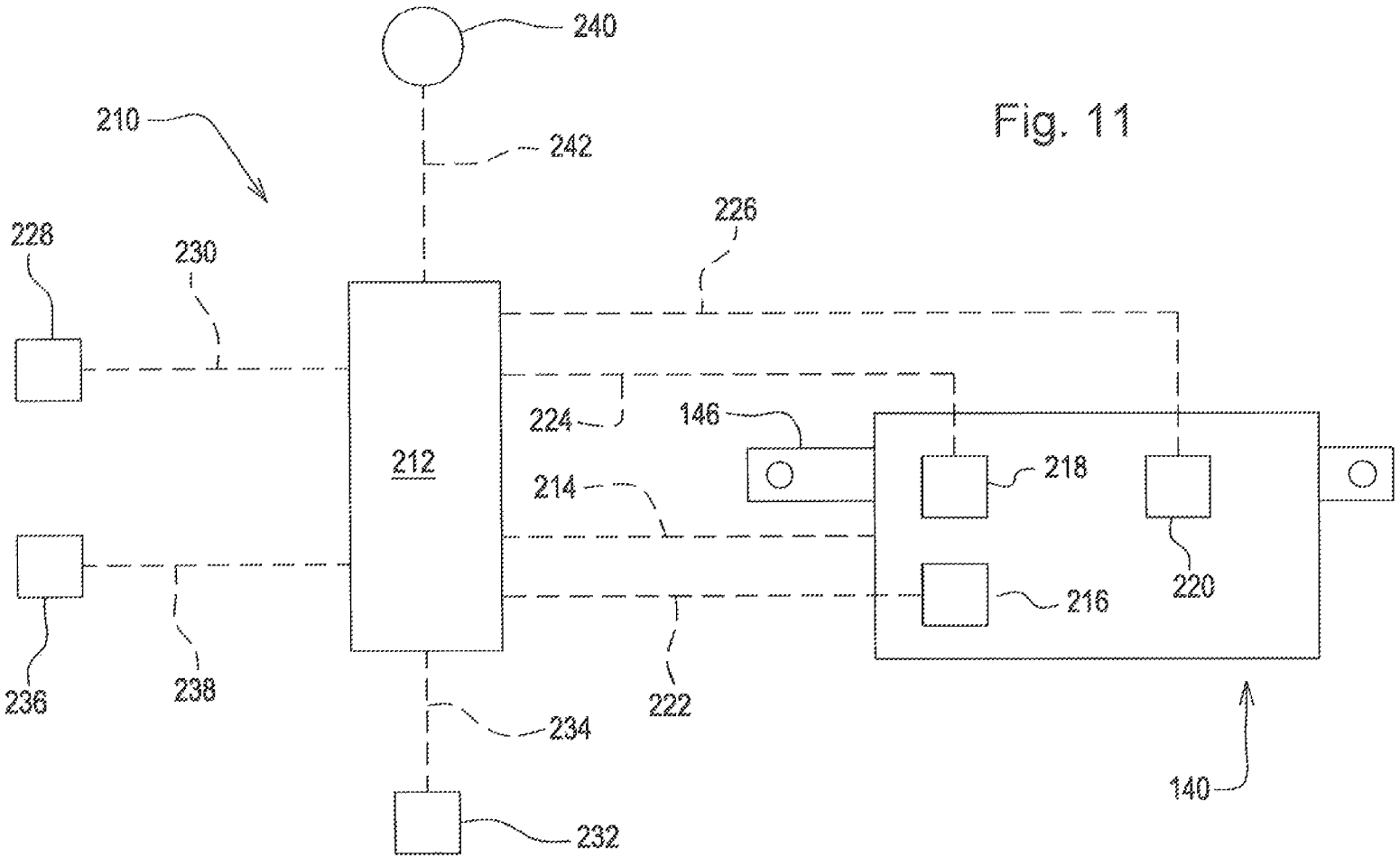
FIG. 11 is schematic of the electrical circuit embodying the microprocessor and sensors used for controlling operation of the electric linear motor and giving an operator visual indication of whether or not the latch rod arrangement is operating correctly.

Referring now to FIG. 11, there is shown a schematic of an electrical control system 210 for remotely controlling the operation of the linear electric motor 140. Specifically, the electric control system 210 includes an electrical control unit (ECU) 212 connected to the motor 140 by a motor activation output signal line 214. The ECU 212 preferably, but not necessarily, is a microprocessor which is embodied in the electric motor 140 and continuously monitors the performance of the motor. For purposes indicated below, the motor 140 embodies an electronic load sensor 216 and end of stroke limit switches 218 (extend limit) and 220 (retract limit) here depicted as being respectively connected to the ECU by conductors 222, 194 and 196. While not required, the end of stroke positions governed by the limit switches 218 and 220 could be programmable.

A manually-operated control switch 228 for initiating activation of the motor 140 is located within the cab (not shown) of a tractor and is connected to the ECU 212 by a motor activation input line 230. The control switch 228 may take various forms including: (1) a momentary "on" rocker switch, (2) a momentary "on" rocker switch with a 1 second delay, (3) a momentary "on" rocker switch with a ½ second delay and a ½ second release window trigger indicated by an LED, (4) a momentary "on" push button switch, (5) a momentary "on" push button switch with a recessed button, and (6) a momentary "on" push button switch with a recessed button with a ½ second delay and a ½ second release window trigger indicated by an LED. Also, instead of a single switch, two momentary toggle switches may be used, with each being toggled in opposite directions. A height sensor 232, shown mounted on the right mast 34 in FIG. 2, is connected to the ECU 182 by a height signal input line 234 and is provided for preventing actuation of the electric motor 140 when the carrier 42 is above a predetermined height off the ground. The boom height sensor 234 detects the pivot angle of the lifting boom 28 about the horizontal axis defined by the coupling pins 32, which secure the boom arms 30 to the masts 34. The height sensor 234 may be, for example, a potentiometer or an incremental angle transmitter which transmits this signal to the ECU 212. Angular regions are stored in memory in the ECU 212, in which an activation of the motor 140 can be prevented at inappropriate positions of the lifting boom 28, for example, if it is raised beyond a height considered to be an upper height limit for safe disconnection of an implement from the carrier 42 mounted to the boom arms 30. The angular regions, in which a signal sent by the height sensor 232 is to be ignored, can be permanently programmed or provided as input by the operator with an input key 236 provided in the tractor cab (not shown) and connected to the ECU by an input signal line 238. The input key 236 can also be used to program the aforementioned travel end limits of the motor output shaft 146.

An LED indicator 240 is provided for apprising an operator of the operating condition of the motor 140 and boom 28 as determined by the load sensor 216, output shaft end limit sensors 218 and 220, and height sensor 232. The LED indicator 240 is coupled to the ECU 212 by an output signal line 242 for receiving operation condition signals from the ECU 212.

Remote operation of the latching mechanism 120 through remote actuation of the linear electric motor 140 is described below with reference to FIGS. 1, 2 and 11. Assuming the implement 14 to be latched to the carrier 42, as shown in FIG. 1, and that the tractor 10 is properly located for depositing the implement 14 on the ground, operation to detach the implement 14 from the carrier is commenced by lowering the loader boom 28 so as to place the implement 14 close to the ground. The bucket tilt actuators 50 are then caused to retract to completely roll back the carrier 42 and associated implement, with the weight of the implement 14 thus being relieved from the latch rods 170 and 172. The normally "off" switch 228 is then momentarily actuated to its "on" position so as to activate the motor 140 to cause extension of the motor shaft 146 and hence extension of the operating rod assembly 150. Since the carrier 42 has been lowered, the height sensor 232 will not be activated and the signal sent by the switch 228 to the ECU 212 will result in an operating signal being sent to the motor 140 by way of the output line 214. The motor 140 will then be activated to cause extension of the output shaft 146 and the operating rod assembly 150. Assuming the latch rod 172 and the latch rod portion 178 are free to move so that no jamming occurs, extension of the latch rod assembly 150 will take place, causing the latch rod 170 and latch rod portion 178 to be fully pulled out of the associated left and right lugs (not shown) provided at the backside of the implement 14. During extension of the motor output shaft 146, the retract limit sensor 220 will initially be activated, then cease to be activated as the shaft moves away from its retract limit position, resulting in the LED indicator 212 receiving a signal causing it to blink slowly indicating continuous outward movement of the output shaft 146. When the output shaft 146 reaches the extend limit position, limit sensor 218 will be activated, sending an input signal to the ECU 212 resulting in the LED indicator receiving a signal causing it to produce a steady light apprising the operator that the unlatch position has been achieved, with the secondary latch pin 186 then being withdrawn from the left guide slot 164. The tension spring 196, together with the motor 140, which is now angled downwardly to the left, will then act to rotate the operating rod assembly 150 to the bottom end of the slots 164, resulting in the secondary latch pin 186 becoming misaligned with the adjacent slot 164 so that the latch rod arrangement 124 is arrested in the unlatched position. The boom 28 can then be lowered to disengage the cross bar 46 from the hooks 48 at the backside of the implement 14, thus permitting the tractor 10 to be backed away from the implement 14.

The implement 14 can once again be attached to the carrier 42 by a reverse operation. Specifically, the tractor 10 can be driven toward the backside of the implement 14 and the boom 28 and carrier 42 lowered so as to place the cross bar 46 beneath the downwardly opening hooks 48. The boom 28 is then raised, with gravity causing the implement 14 to pivot downwardly about the axis of the cross bar 46 and rest against the carrier 42, with left and right lugs at the backside of the implement 14 respectively being received between the right latch rod receiving plate 72 and right strengthening plate 64, and between the left latch rod receiving plate 78 and the left strengthening plate 66. To ensure axial alignment of the bores in the bucket lugs with the holes of the receiving plates 72, 78 and the strengthening plates 64, 66, the tilt cylinders 50 are retracted to effect full roll back of the carrier 42 and associated implement 14. Not only does this result in the desired bore and hole alignment mentioned above, but it also results in the tubular section 160 of the operating rod assembly 150 coming into engagement with the top surface of the left loader boom 30 and being lifted towards the top of the guide slots 164, this lifting initially resulting in the right end of the secondary latch pin 186 entering the left guide slot 164. The normally open, motor actuating switch 228 is then manually actuated to send a motor control signal to the ECU 212. The ECU 212 will then send a motor activating signal causing the motor 140, at one second intervals, to attempt to retract. If the motor 140 causes the right and left latch rods 170 and 172 to move more than 5 mm., then the motor retracts under full power and the LED indicator 232 blinks slowly. If either one or both of the latch rods 170 and 172 jam, then an overload condition is sensed by the overload sensor 216 which sends a jam signal to the ECU 212 resulting in an output signal being sent to the LED indicator 242 which causes the LED to blink rapidly, with power to the motor 140 via the line 214 being terminated, with the motor 140 going into a latch mode causing the output rod 160 to be retracted. If, instead of a jam occurring, the retract limit of the motor output shaft 146 is reached, the retract limit sensor 220 is activated resulting in the ECU 212 receiving a signal which is processed, the ECU 212 then terminating power to the LED indicator 240, which shuts off, and with power simultaneously being cut to the motor 140.

If jamming happens during latching operation, the operator may use the input key 236 to send an override signal to the ECU 212, which permits the motor control switch 228 to be intermittently switched "on" and "off" so that the motor 140 is intermittently energized so as to cause the output shaft 146 to extend and retract with the result that the latch rod portion 178 and latch rod 172 are moved back and forth so as to chip away at any material that may be causing an obstruction in the aligned holes provided on the carrier 42 and the lugs (not shown) at the backside of the implement 14. Upon the material becoming dislodged, the input key 236 can be operated to send a signal to the ECU 212 for resumption of normal operation.

Thus, it will be appreciated that the electric linear motor 140 makes it possible to remotely effect attachment and detachment of an implement 14 to and from arms 30 of a loader boom 28, and that the boom height sensor 232 together with the ECU 212 prevents the operator from inadvertently unlatching the implement when the boom 28 is positioned in other than a safe lowered position, while the various motor operation sensors together with the ECU 212 and the LED indicator 240 inform the operator as to whether there is a jam preventing the motor 140 from effecting desired latching or unlatching operations.

In the event of a failure of the linear electric motor 140, the motor output shaft 146 can be disconnected from the operating rod assembly 150 by removing one or both of the nut and bolt assemblies 156 and 158. Operation of the latch rod assembly 124 can then be performed manually. Movement of the operating rod assembly 150 to effect the unlatched arrested position can be accomplished by grasping the handle 168 and pulling outwardly on the operating rod assembly 150 against the bias of the spring 188 until the secondary latch rod 186 is pulled free of the guide slot 164 provided in the left plate 60. The handle 168 may then be used to pivot the lever arm 166 downwardly so that the operating rod 132 moves to the bottom of the guide slots 164, with the secondary latch rod 186 then being misaligned relative to the guide slot 164 so as to prevent rightward movement of the operating rod assembly 150 by the compressed spring 188. The latch rod 172 and latch rod portion 178 are then in respective positions to the left of left and right lugs (not shown) provided at the backside of the implement 14 and disposed between the rod receiving plate 78 and strengthening plate 66, and between the right receiving plate 72 and strengthening plate 64.

Having described the preferred embodiment, it will become apparent that various modifications can be made without departing from the scope of the invention as defined in the accompanying claims.

The invention claimed is:

1. In a combination including a remotely controlled latching mechanism for selectively securing an implement to an implement carrier mounted to a work machine lifting arm for pivotal movement about a horizontal, transverse tilt axis, a hydraulic tilt cylinder coupled between said lifting arm and said carrier, said latching mechanism including a latch rod arrangement reciprocably mounted on said carrier and including right and left latch rods respectively received in right and left sets of holes provided in said carrier and aligned with bores provided in right and left lugs of said implement for securing said implement to said carrier when said latch rod arrangement is in a retracted latch position, and an extensible and retractable actuator being coupled to said latch rod arrangement and being selectively operable between a retracted position holding said latch rod arrangement in a corresponding retracted latched position, for securing said implement to said carrier, and an extended position holding said latch rod arrangement in a corresponding extended unlatched position, the improvement comprising: said actuator being a remotely operable linear electric motor, and further including an electrical control system including a microprocessor based electrical control unit coupled to said electric motor and including a manually operable motor control switch for selectively effecting off, extend and retract conditions in said motor; an indicator device being coupled for receiving an output signal from said control unit; said control unit being coupled for receiving input signals relating to a current operating condition of said motor and for causing said indicator device to respectively apprise the operator if the latch rod arrangement is extending freely, is stalled or is fully extended when the switch is operated to effect extension or retraction of said linear electric motor.

2. The combination, as defined in claim 1, wherein said electrical control system includes a lifting arm height sensor coupled to send a height signal to said control unit; and said control unit being operative in response to said height signal indicating a height above a preselected height to block power to the electric motor in the event said manually operable switch is operated to activate said motor when said lifting arm is located above said preselected height.

3. The combination, as defined in claim 1, wherein said linear electric motor includes an extensible and retractable output shaft; said electrical control system including an output shaft movement sensor arrangement being provided for sensing when said output shaft is at preselected retracted or extended limits respectively corresponding to said latch rod arrangement being in said latched and unlatched positions and being connected to said electrical control unit for sending corresponding signals to said electrical control unit; and said indicating device comprising an LED connected to said electrical control unit; and a motor overload sensor connected to said electrical control unit, with said control unit being operable, once said motor control switch has been operated to energize said motor to effect extension or retraction of said motor, for causing said LED to blink slowly in the event no overload is sensed by said overload sensor once said motor control switch has been operated, for causing said LED to blink rapidly in the event said motor overload sensor senses an overload, and for shutting off said LED and cutting power to said motor once said shaft movement sensor arrangement senses that said shaft has moved from one to another of said retracted or extended limits.

4. The combination, as defined in claim 3, wherein said electrical control system includes a manual input key coupled to said electrical control unit and being operable for sending an override signal to said electrical control unit when an overload condition is sensed after said motor is actuated to retract said motor shaft in order to move said latch rod arrangement to said latched position, the override signal permitting said motor to be alternately extended and retracted by operation of said manually operable motor control switch such that said latch rods move back and forth and impact and dislodge any material blocking passage of said latch rods into said aligned holes and bores.

5. In a combination including a remotely controlled latching mechanism for selectively securing an implement to an implement carrier mounted to a work machine lifting arm for pivotal movement about a horizontal, transverse tilt axis, a hydraulic tilt cylinder coupled between said lifting arm and said carrier, said latching mechanism including a latch rod arrangement reciprocably mounted on said carrier and including right and left latch rods respectively received in right and left sets of holes provided in said carrier and aligned with bores provided in right and left lugs of said implement for securing said implement to said carrier when said latch rod arrangement is in a retracted latch position, and an extensible and retractable actuator being coupled to said latch rod arrangement and being selectively operable between a retracted position holding said latch rod arrangement in a corresponding retracted latched position, for securing said implement to said carrier, and an extended position holding said latch rod arrangement in a corresponding extended unlatched position, the improvement comprising: said actuator being a remotely operable linear electric motor, wherein said right and left latch rods include at least respective rod end sections which are disposed generally parallel to said tilt axis and define a horizontal latching axis; said right and left sets of holes being provided in right and left vertical plates of said carrier which respectively straddle said right and left lugs of said implement, with said rod end sections of said right and left latch rods projecting through said right and left sets of holes and said right and left lugs when said latch rod arrangement is in said latch position; said latch rod arrangement including an operating rod disposed in parallel relationship to said tilt axis and having an end region located within guide openings provided in a loader boom mounting vertical plate arrangement provided at one side of said carrier; and said electric motor being supported by said carrier and having an extensible and retractable output shaft coupled directly to an end of said operating rod assembly.

6. The combination, as defined in claim 5, wherein said hole arrangement is a slot arrangement spaced from said tilt axis; a lever arm being fixed to an outer end of said operating rod assembly on an opposite side of said vertical plate arrangement from said electric motor; said lever arm being engaged with an outer surface of said vertical plate arrangement; a secondary latch pin being secured to said lever arm and projecting into a lower end region of said slot arrangement when said latch rod arrangement is in said latched position, and being withdrawn from said slot arrangement when said latch rod arrangement is in said unlatched position; a biasing spring being coupled to said control bar and acting in a direction tending to pivot said latch rod arrangement about said latching axis so as to move said operating rod assembly into said lower end region of said slot arrangement, whereby said biasing spring moves said operating rod assembly downwardly into said lower region of the slot arrangement when said secondary latch rod is withdrawn from said guide slot arrangement thereby placing said secondary latch rod in a location misaligned with said guide slot arrangement with a free end abutting said outer surface of said vertical plate arrangement to thereby establish an arrested condition of said latch rod arrangement preventing movement of the latch rod arrangement from said unlatched position.

7. The combination, as defined in claim 6, wherein said motor is mounted to the carrier for pivoting about an upright axis, with the motor pivoting downwardly about said upright axis when extending so that a downward force is exerted on the operating rod assembly which aids movement of the operating rod assembly to said lower region of said guide slot arrangement when said latch bar arrangement is being moved from said latched to said unlatched position.

8. The combination, as defined in claim 6, wherein said operating rod assembly is so located relative to said tilt axis and said lifting am that said lifting arm contacts and moves said operating rod assembly toward an upper end region of said slot arrangement permitting said secondary latch rod to enter said slot arrangement when said carrier is rolled back by said tilt cylinder.

9. The combination, as defined in claim 8, wherein said secondary latch rod is inclined upwardly toward said operating rod assembly, whereby, when said electric motor is retracted to once again place said latching rod arrangement in its latched position, said secondary latch rod moves into said lower region of said guide slot arrangement thereby preventing said biasing spring from moving said operating rod assembly into said lower region of the guide slot arrangement.

* * * * *